United States Patent [19]

Bahls

[11] Patent Number: 4,737,188

[45] Date of Patent: Apr. 12, 1988

[54] REDUCING AGENT AND METHOD FOR THE ELECTROLESS DEPOSITION OF SILVER

[75] Inventor: Harry J. Bahls, North Haven, Conn.

[73] Assignee: London Laboratories Limited, Woodbridge, Conn.

[21] Appl. No.: 52,239

[22] Filed: May 18, 1987

[51] Int. Cl.[4] ..... C23C 18/44; C23C 18/54

[52] U.S. Cl. ..... 106/1.23; 106/1.13; 106/119; 427/304; 427/437; 427/443.1

[58] Field of Search ..... 106/105, 1.11, 1.13, 106/1.19, 1.23, 1.26; 204/19, 38.4; 427/304, 437, 407.2, 443.1, 404, 164, 165

[56] References Cited

U.S. PATENT DOCUMENTS

| | | | |
|---|---|---|---|
| 3,095,302 | 6/1963 | Jeffreys et al. | 96/11 |
| 3,338,716 | 8/1967 | Gardner, Jr. et al. | 96/113 |
| 3,625,691 | 12/1971 | Ohyama et al. | 96/57 |
| 3,776,740 | 12/1973 | Sivertz et al. | 106/1 |
| 4,102,702 | 7/1978 | Bahls | 106/1.23 |
| 4,192,686 | 3/1980 | Soltys | 106/1.23 |

OTHER PUBLICATIONS

*Carbohydrate Chemistry,* Guthrie, R. D. and Honeyman, John, 4th Edition, 1984, pp. 56–61.

*The Carbohydrate Chemistry and Biochemistry;* Pigman, Ward and Horton, Derek, 1970–Chapter on "Amino Sugars"; Horton, Derek; vol. IA, pp. 643–647 and 726–737.

*The Carbohydrate Chemistry and Biochemistry;* Pigman, Ward and Horton, Derek, 1962, pp. 474–477.

*Primary Examiner*—Paul Lieberman
*Assistant Examiner*—Helene Kirschner
*Attorney, Agent, or Firm*—DeLio & Associates

[57] ABSTRACT

A brighter, more uniform deposit of electroless silver is achieved over a wider temperature range by employing as a reducer a compound represented by the general formula:

$$R^2—(CHR^1)_n—CH_2OH$$

where n is two (2) to seven (7), $R^2$ is represented by the formula COOH or $CH_2R^1$, each $R^1$ group is independently selected from the class consisting of OH, $NH_2$, $NHCH_3$, $NHC_2H_5$ or $NHC_3H_7$ and at least one of the $R^1$ groups is $NH_2$, $NHCH_3$, $NHC_2H_5$ or $NHC_3H_7$.

Preferred reducers are N-methylglucamine, d-glucamine and glucosaminic acid.

33 Claims, No Drawings

REDUCING AGENT AND METHOD FOR THE ELECTROLESS DEPOSITION OF SILVER

BACKGROUND OF THE INVENTION

This invention relates to the electroless deposition of metallic silver on various substrates. In particular the invention relates to a novel reducing agent for the deposition of silver onto a substrate such as glass, plastic, ceramic or lacquer surfaces in addition to the coating of mirrors, decorative objects, and other non-conductive surfaces requiring a reflective, conductive or decorative metallic film.

The use of reducing agents for the electroless deposition of silver is well-known. Some of the earliest known reducing agents were agents such as formaldehyde, glucose and invert sugar. However, such prior art reducing agents tended to be unstable in use, often evolving hydrogen or decomposing to form sludge or other by-products. Dextrose, fructose, and arabinose are also known as prior art reducing agents.

U.S. Pat. No. 3,776,740 issued to Sivertz et al. disclosed the use of an aldonic acid (such as gluconic acid) and the salts thereof, (such as sodium gluconate) as improved reducing agents. Such reducing agents are stable in strong alkali solutions which permitted the formulation of nonexplosive silvering solutions. Their stability prevented the prior art problems of decomposition of the reducing agent in a highly alkaline solution.

U.S. Pat. No. 4,102,702 issued to the present inventor disclosed the use of a reducer containing a polyhydric alcohol which improved the efficiency of the silver deposition process. The preferred alcohol was sorbitol. U.S. Pat. No. 4,192,686 issued to Soltys disclosed the use of sorbitol in a nonexplosive two-part silver composition and process.

Reducing agents such as are disclosed in U.S. Pat. Nos. 3,776,740, 4,102,702 and 4,192,686 are extremely efficient when used at room temperatures. At higher temperatures (100°-125° F., 38°-52° C.) there is an increased possibility that such "cold reducers" will produce "reducer burn" (also referred to as "silver blush") wherein the silver film loses most of its adhesion to the glass surface. Such higher temperatures can be reached inadvertently in warmer climates.

Furthermore, the reducing agents disclosed in U.S. Pat. Nos. 3,776,740 and 4,102,702 in many cases produce a silver film which has a streaky blue-white coloration on the first surface. The "first" surface is the surface of the silver deposit farthest removed from the silver/glass interface. The streaks are caused by the rapid reduction of the silver when the reducer is used in a highly alkaline silvering solution. The streaks and blue-white coloration are also accentuated at higher temperatures.

As a result, the reducing agents such as sodium gluconate and polyhydric alcohols disclosed in U.S. Pat. Nos. 3,776,740 and 4,102,702 are not suitable for use where inadvertently high temperatures may be found or in applications where the appearance of the first surface is a primary concern. Such applications include decorative items, mirror frames, bottle cap closures and other reflective, conductive, and decorative applications.

Other known reducing agents, such as invert sugar, require higher temperatures to develop an efficient deposit of silver, e.g. temperatures in the range of 110°-130° F. (43°-54° C.). Below this range, they are very inefficient in depositing silver and thus are more costly to use.

The reducing agents of the present invention are stable in strong alkaline solutions permitting the use of nonexplosive silvering methods and formulations. They are more resistant to reducer burn (silver blush), than the gluconate and polyhydric alcohol reducers of the prior art, particularly at higher temperatures, and they operate efficiently within a temperature range of 70°-130° F. (21°-54° C.) which is broader than that of the prior art.

As a result, they produce a smoother, brighter and more uniform silver coating, without streaks, over a wider range of temperatures than previously known reducing agents. The reducers of this invention have been found to deposit silver not only on glass, but also on plastic surfaces, such as polycarbonate, poly-methylmethacrylate, and styrene. Thus they are suitable not only for mirrors, thermos bottles, Christmas ornaments and electroforming, but also on surfaces where a bright, highly reflective first surface is required such as on plastic bottle cap closures and decorative applications, etc.

SUMMARY OF THE INVENTION

The compounds of this invention are those represented by the following general formula:

$$R^2-(CHR^1)_n-CH_2OH$$

where n is 2 to 7, $R^2$ is represented by the formula COOH or $CH_2R^1$, each $R^1$ group is independently selected from the class consisting of OH, $NH_2$, $NHCH_3$, $NHC_2H_5$ and $NHC_3H_7$ and at least one of the $R^1$ groups is $NH_2$, $NHCH_3$, $NHC_2H_5$ or $NHC_3H_7$.

The preferred reducers are those where an amine group is substituted for a hydroxyl group of glucose. The amine group is preferably substituted on the first carbon atom but may be substituted on other carbon atoms of the glucose molecule. Furthermore, the amino group that is attached to a carbon can have one of its hydrogen atoms replaced with an alkyl group such as a methyl, ethyl or propyl group, and preferably a methyl group.

DETAILED DESCRIPTION OF THE INVENTION

In the preferred embodiment of the reducer of this invention, n is four (4) in the structural formula above and exactly one of the $R^1$ groups is $NH_2$ or $NHCH_3$, the remainder being OH.

The structural formulae for effective reducing agents according to the preferred embodiment are:

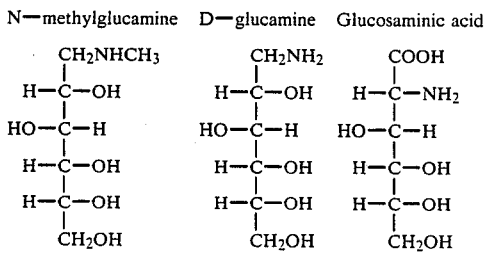

N-methylglucamine and glucosaminic acid are the most highly preferred of the reducing agents according to this invention.

The reducing agents of this invention are suitable for use with any silver composition in which silver is present in the ionic state and which is sufficiently water soluble for contact with, and reduction by, the reducer. Accordingly, any of the well-known silver compounds or salts, inclusion complexes, coordination compounds (Werner complexes), and the like, will be effective provided the compositions have the necessary water solubility and that interfering reactions are avoided. Among the useful compounds are the soluble silver salts such as silver nitrate and the like.

The preferred ionic silver composition is one in which the silver ion is complexed, since not only is the solubility of the silver compound improved thereby, but also the tendency toward precipitation of silver at an alkaline pH is reduced. Ammonia is the preferred complexing agent for these purposes and forms with silver nitrate the silver diamine ion, $Ag(NH_3)_2^+$.

In the present method, as in most industrial processes for the electroless deposition of silver, a highly alkaline medium is desirable for acceptable rates of reaction. A pH of at least about 12 will be suitable and preferably a pH of 12.7 or higher should be used. The alkalinity may be provided by any suitable means, preferably by the presence of a strong base such as sodium hydroxide, potassium hydroxide or the like.

The relative proportions of reactants in the silvering solutions of the inventions may vary over a wide range. For example, tests have shown that acceptable deposits of silver can easily be obtained when the molar ratio of the reducer to the silver compound, such as silver nitrate, ranges from about 1:10 to 1:0.5 (reducer:silver). It is presumed that ratios outside this range could also be employed with less effectiveness. Preferably, the molar ratio will be in the range of about 1:6 to 1:2.

Various other considerations of the reaction are within the skill of the art and may be varied accordingly. These include the absolute concentrations of various reactants, the total hydroxyl ion concentration in the reaction mixture, temperature and duration of reaction, and the manner in which the silvering solution is applied to the substrate.

As illustrated in the examples, the stability of the reducers of the present invention in alkaline solutions permit them to be used in any of the methods of the prior art. For example, the reducer may be used in a prior art method which utilizes reducers which are not stable in strong alkaline solutions. In this method, the reducer comprises a separate solution. The reducer solution is then added to a previously prepared solution of sodium hydroxide and ammoniacal silver nitrate shortly before or simultaneously with application of the final reaction mixture to the substrate upon which it is desired to deposit a silver film.

In a more highly preferred method, the silver nitrate and the ammonium hydroxide complexing agent may form a first solution and the reducer and a strong base such as sodium hydroxide may form a second solution. The second solution may also include some of the ammonium hydroxide. The two solutions are then admixed in a two-part process as required to deposit the silver. A variation on this method is to provide a portion of the reducer in the first solution and the remainder in the second solution.

In a third method, the reducer may be provided in a first solution with silver diamine, and a second solution may contain the strong base and ammonium hydroxide complexing reagent. These two solutions are then admixed in a two-part process when it is desired to deposit the silver. Similar to the previous method, a portion of the reducer may be present in each of these two solutions prior to admixture.

In another method, a conventional three-part process may be used wherein the silver nitrate and the ammonium hydroxide complexing agent form a first solution. The reducer (with or without a prior art reducer) forms a second solution and a strong base such as sodium hydroxide with ammonium hydroxide forms a third solution. The three solutions are then admixed shortly before or simultaneously with application of the final three-part reaction mixture to the substrate on which it is desired to deposit the silver film.

In still another method of preparing the reaction mixtures, a prior art reducing agent for the electroless deposition of silver may be employed in conjunction with the reducers of the invention. For example, the conventional techniques for admixture of the reactants may be utilized with the exception that a known reducer, such as a polyhydric alcohol or an aldonic acid is present in the solution of the reducer of the invention. Alternatively, a three-part process may be used wherein one solution contains a conventional reducer (with or without the reducer of this invention), a second solution may contain the strong base and reducer of the invention, and a third solution may contain the silver diamine reactant. In either case, upon admixture of the three solutions, silver is deposited as a coating.

Accordingly, it is known in the art that an invert sugar, when used in a conventional three-part process, can also be used in combination with an explosion-inhibiting reducer. Thus, the reducers of this invention provide the advantage of rendering a conventional three-part process nonexplosive. The reducer of this invention can be added to either the silver diamine concentrate, the alkali concentrate or to both concentrates.

Reduction by invert sugar proceeds slowly and is inefficient at room temperatures. Therefore, higher temperatures are required to obtain an efficient deposition process. Previous explosion-inhibitor reducers such as sodium gluconate and sorbitol perform efficiently at room temperature conditions. However, when these prior art explosion-inhibiting reducers are used at higher temperatures, they are subject to silver blush. Thus, a further advantage is provided by using the reducers of the invention with an invert sugar process in that silver blush is not produced at the elevated temperatures required for the use of invert sugar.

Regardless of the method of preparing the reaction mixtures, after their preparation they are brought together before or at contact with the substrate to be silvered. This may be achieved in a variety of ways known to those skilled in the art. For example, the component solutions may be poured or pumped such that they meet just before contact with the substrate. Alternatively, the component solutions may be sprayed using an air or airless system prior to or simultaneously with intermixing at the surface of the substrate. Normally, also, the component solutions are first formulated as concentrates, to be stored and later diluted at time of use.

A wide variety of optional ingredients may be added to the silvering solution of the invention which essentially comprises the aqueous medium containing a water soluble ionic silver composition and reducing agent. For example, buffers such as ammonium nitrate or ammonium citrate may be advantageously employed. As indicated, it is preferred to enhance the rate of deposition by the addition of a strong base such as an alkali metal hydroxide, of which sodium hydroxide is representative.

The following examples are intended as further illustration of the invention but are not necessarily limitative except as set forth in the claims. All parts and percentages are by weight unless otherwise indicated.

EXAMPLE I

In this example one of the preferred reducers, N-methylglucamine, was mixed in a solution of sodium hydroxide and ammonium hydroxide to form a concentrated solution. The concentrate was diluted 30 times with deionized water and allowed to react in a beaker sensitized with stannous ions using a 30 times dilution of a concentrated silver diamino nitrate solution.

The concentrated solutions were prepared as follows:

(1) Silver Concentrate
250 grams/L silver nitrate
44 ml/L ammonium hydroxide (28% $NH_3$)
Diluted to 1 liter with deionized water (2) Alkaline Reducer Concentrate
200 grams/L sodium hydroxide
100 ml/L ammonium hydroxide (28% $NH_3$)
75 grams/L N-methylglucamine
diluted to 1 liter with deionized water (3) Tin Sensitizer
1 gram/L stannous chloride A 250 cc beaker was cleaned, rinsed with deionized water and sensitized with the stannous solution. The beaker was then rinsed again in deionized water. Equal volumes of the diluted silver and alkali reducer concentrates were measured and mixed in the sensitized beaker. The reaction temperature was 70° F. (21° C.) and the reaction was allowed to run one minute. The result was a smooth, uniform and brilliant deposit of silver on the first surface.

EXAMPLE II

The procedure of Example I was repeated under the same conditions of temperature and concentration with the second of the two preferred reducers, glucosaminic acid.

The silver concentrate and tin sensitizer of Example I were used as described therein. The alkaline reducer concentrate also remained the same except that the N-methylglucamine was replaced by 75 grams/L of glucosaminic acid.

The result of the reaction was a deposit of silver that was smooth, uniform and brilliant on the first surface.

COMPARATIVE EXAMPLE I

The procedure of Examples I and II was comparatively repeated under the same conditions of temperature and concentration except that sodium gluconate was used as the reducing agent instead of N-methylglucamine or glucosaminic acid.

COMPARATIVE EXAMPLE II

The procedure of Examples I and II was comparatively repeated under the same conditions of temperature and concentration except that sorbitol was used as the reducing agent instead of N-methylglucamine or glucosaminic acid.

When the silver films produced in Examples I and II with the preferred reducers were compared to the films produced in Comparative Examples I and II, the films produced using the preferred reducers were significantly more brilliant on the first surface than the ones prepared using sodium gluconate and sorbitol. The films deposited by sodium gluconate and sorbitol were off-color, being very blue-white in appearance and hazy, when compared to the N-methylglucamine and glucosaminic acid reduced silver films.

EXAMPLE III

In this example N-methylglucamine was dissolved in a silver diamine nitrate concentrate. The formulas for the concentrated solutions were as follows:

Silver Concentrate
250 grams/L silver nitrate
440 ml/L ammonium hydroxide (28% $NH_3$)
75 grams/L N-methylglucamine
20 grams/L ammonium nitrate
Diluted to 1 liter with deionized water Alkali Concentrate
200 grams/L sodium hydroxide
100 ml/L ammonium hydroxide (28% $NH_3$)
Diluted to 1 liter with deionized water The silver concentrate and alkali concentrate were diluted thirty times each with deionized water. A 250 cc beaker was cleaned, rinsed with deionized water and sensitized with stannous chloride in the same fashion as was performed in Example I. Equal volumes of each solution were then mixed and reacted in the beaker.

The reaction temperature was 70° F. (21° C.), and the reaction was allowed to run for 1 minute. The result was a very brilliant and uniform deposit of silver.

COMPARATIVE EXAMPLE III

The procedure of Example III was comparatively repeated under the same conditions of temperature and concentration except that sodium gluconate was used as the reducing agent.

When the beakers were compared, the one produced using N-methylglucamine as the reducer (Example III) was far more reflective and brilliant than the one produced using sodium gluconate (Comparative Example III).

COMPARATIVE EXAMPLE IV

The procedure of Example III was comparatively repeated under the same conditions of temperature and concentration except that glucono-delta-lactone was used as the reducing agent.

When the beakers were compared, the one produced using N-methylglucamine as the reducer (Example III) was far more reflective and brilliant on the first surface than the one produced using glucono-delta-lactone (Comparative Example IV).

EXAMPLE IV

In this example N-methylglucamine was dissolved in deionized water to demonstrate the use of those reducers as a conventional three-part process. The formulas for these concentrated solutions were are follows:

Silver Concentrate
250 grams/L silver nitrate
440 ml/L ammomium hydroxide (28% $NH_3$)
Diluted to 1 liter with deionized water Alkali Concentrate
200 grams/L sodium hydroxide
100 ml/L ammonium hydroxide (28% $NH_3$)
Diluted to 1 liter with deionized water Reducer Concentrate 75 grams/L N-methylglucamine
Diluted to 1 liter with deionized water.

The silver, alkali and reducer concentrates were separately diluted thirty times with deionized water. A 250 cc beaker was cleaned, rinsed with deionized water and sensitized with stannous chloride in the same fashion as was performed in Example I. Equal volumes of each solution were simultaneously mixed and reacted in the beaker.

The reaction temperature was 70° F. (21° C.) and the reaction was allowed to continue for 1 minute. The result was a very brilliant and uniform deposit of silver.

EXAMPLE V

The solutions used in Example I were tried on an apparatus built to simulate a mirror conveyor. This apparatus enabled one to accurately pump measured quantities of concentrated solutions into water streams of deionized water providing a controlled 30 times dilution of the concentrated solutions. The water streams containing the diluted concentrates were then sprayed through spray tips at a controlled rate onto the mirror surface. This setup allowed one to precisely control the amount of silver deposited, the reaction time and the reaction temperature.

Under the condition of equal pump rates for the silver concentrate and the alkali reducer concentrate, the temperature of the water was varied, and the temperature of the glass was varied.

The N-methylglucamine reducer concentrate and the silver concentrate as prepared in Example I were run at 70° F., 85° F., 95° F., 105° F. and 110° F. (21° C., 29° C., 35° C., 41° C. and 43° C.). The reaction was allowed to continue for 40 seconds before the spent solutions were rinsed off the silver film.

In each case, the first surface of the silver film deposit was very brilliant, and in all cases the deposit of the silver was not streaky.

COMPARATIVE EXAMPLE V

The procedure of Example IV was comparatively repeated under the same conditions of concentration and over the same series of temperatures except that sodium gluconate was used as the reducing agent.

When the silver films were compared, the first surface of the mirror produced with sodium gluconate was very streaky and had developed a blue-white color. The spray tip pattern could be easily seen on the first surface. The film produced with N-methylglucamine showed a much more uniform deposit of silver at all temperatures tested, whereas the sodium gluconate reduced silver films showed more streaks and haze as the temperature was increased.

COMPARATIVE EXAMPLE VI

The procedure of Example IV was comparatively repeated under the same conditions of concentration and over the same series of temperatures except that glucono-delta-lactone was used as the reducing agent.

When the silver films were compared, the first surface of the mirror produced with glucono-delta-lactone was very streaky and developed a blue-white color to the silver film. The spray tip pattern could be easily seen on the first surface. The film produced with N-methylglucamine showed a much more uniform deposit of silver at all temperatures tested, whereas the glucono-delta-lactone reduced silver films showed more streaks and haze as the temperature was increased.

EXAMPLE VI

A concentrated silver solution was prepared by dissolving glucosaminic acid in the silver solution. The alkali concentrate was the same as that used in Example III. The silver concentrate was prepared as follows:

Silver Concentrate
250 grams/L silver nitrate
440 ml/L ammonium hydroxide (28% Ammonia)
75 grams/L glucosaminic acid
20 grams/L ammonium nitrate
Diluted to 1 liter with deionized water The silver and alkali concentrates were diluted 30 times each with deionized water. The diluted solutions were reacted in a clean, sensitized beaker using equal quantities of each component.

The temperature of the reaction was varied using a water bath with controls to vary the bath water temperature. The diluted solutions were stored in this water bath, and the beaker used in the reaction was allowed to warm in this bath. The reaction was allowed to proceed for 1 minute at 70° F., 85° F., 100° F. and 120° F. (21° C., 29° C., 35° C., 41° C. and 43° C.).

At each temperature, glucosaminic acid deposited a uniform and brilliant silver film. The initial deposit of silver was slow, and the silver film deposited at a uniform rate.

COMPARATIVE EXAMPLES VII–IX

The procedure of Example V was comparatively repeated under the same conditions of concentration and over the same series of temperatures except that in Comparative Example VII sorbitol was used as the reducer. In Comparative Example VIII sodium gluconate was used as the reducer and in Comparative Example IX glucono-delta-lactone was used.

The silver film deposited by glucosaminic acid (Example V) at these various temperatures was compared with the silver films produced with sorbitol (Comparative Example VIII), sodium gluconate (Comparative Example VIII) and glucono-delta-lactone (Comparative Example IX). In all cases, the first surface silver film deposited by glucosaminic acid was brighter and more uniform.

EXAMPLE VII

Poor silver adhesion to glass occurs when prior art reducers are operated at high temperatures. This problem is also aggravated if the sprayed solutions are allowed to remain on the freshly deposited silver film for a prolonged period of time.

The phenomenon of poor adhesion has been referred to in the mirror business as "reducer burn" (silver blush). In this example, the reducer burn properties of N-methylglucamine were compared with sodium gluconate (Comparative Example X). The N-methylglucamine reducer was the same as that used in Example I.

In this test the water temperature used to mix with the concentrated chemicals was 110° F. (43° C.). The glass substrate was warmed to 105° F. (41° C.) using a hot plate. After the solutions were sprayed on the glass substrate, the solutions were allowed to remain on the glass surface for six minutes. At that point, the solutions were rinsed off the silver film, and the glass sample was examined visually for reducer burn. Reducer burn, if present, is easily seen by the naked eye and has the appearance of being a white haze or cloud that appears sporadically throughout the mirror, visible through the glass at the silver/glass interface, or second surface. The reason for this is that much of the silver film has lost contact with the glass surface, and as a result, light striking the glass surface is scattered and appears to one's eye to be a haze instead of the desired flat specular reflection.

Under these temperature and reacting conditions, the reducer solution using N-methylglucamine did not develop reducer burn.

COMPARATIVE EXAMPLE X

The procedure of Example VII was comparatively repeated under the same conditions of temperature and concentration except that sodium gluconate was used as the reducer.

Under these temperature conditions, the sodium gluconate reducer developed reducer burn over substantially all of the reflective surface of the glass.

EXAMPLE VIII AND COMPARATIVE EXAMPLES XI AND XII

In this example the blush resistant properties of N-methylglucamine (Example VIII) were compared to that of sorbitol (Comparative Example XI) and glucono-delta-lactone (Comparative Example XII). Blush or reducer burn, as described above, is caused by the partial loss of adhesion of the silver deposit to the glass surface. This generally occurs if the reaction proceeds too quickly. As a result the silver film loses contact with the glass surface due to interfering chemical reactions caused by high temperatures. (See Table I).

This comparison test was made on a mechanical device which simulates a mirror conveyor. The glass substrate rests on a plate with an enclosed water bath on the underside which is heated by flowing warm water therethrough. The water temperature under the plate was controlled using a water mixing valve which mixes hot and cold water proportionately to reach the desired operating temperature.

A console metering device was used to control the amount of chemical concentrate and water that was metered to the spray tips and then onto the glass substrate. The temperature of the metered water was also controlled using a water mixing valve which mixes hot and cold water proportionately.

The speed of the conveyor mechanism was the same for each test. The tests were made with the console water temperature set at 105° F. (41° C.), and the hot plate temperature set at 125° F. (52° C.). The reaction time was allowed to run from 2 minutes up to 10 minutes.

As shown in Table I, N-methylglucamine is far superior to sorbitol and glucono-delta-lactone reduced silver films in silver blush resistance. Without being limited to any theory of operation, it is believed that the unique chemistry of N-methylglucamine controls the rate of silver deposition and prevents the side reactions (that are believed to cause blush) from interfering in this control over the rate of reaction.

TABLE I

| Reducer Type | Console Temp. °F. (°C.) | Hot Plate Temp. °F. (°C.) | Reaction Time (minutes) | Result - % Blush on 432 sq. in. |
|---|---|---|---|---|
| Glucono-delta lactone | 105 (41) | 125 (52) | 10 | 50% |
| Sorbitol | 105 (41) | 125 (52) | 10 | 50% |
| N—methylglucamine | 105 (41) | 125 (52) | 10 | 5% |
| Glucono-delta-lactone | 105 (41) | 125 (52) | 6 | 25% |

TABLE I-continued

| Reducer Type | Console Temp. °F. (°C.) | Hot Plate Temp. °F. (°C.) | Reaction Time (minutes) | Result - % Blush on 432 sq. in. |
|---|---|---|---|---|
| Sorbitol | 105 (41) | 125 (52) | 6 | 25% |
| N—methylglucamine | 105 (41) | 125 (52) | 6 | 5% |
| Glucono-delta-lactone | 105 (41) | 125 (52) | 4 | 10% |
| Sorbitol | 105 (41) | 125 (52) | 4 | 10% |
| N—methylglucamine | 105 (41) | 125 (52) | 4 | <5% |
| Glucono-delta-lactone | 105 (41) | 125 (52) | 2 | 5% |
| Sorbitol | 105 (41) | 125 (52) | 2 | 5% |
| N—methylglucamine | 105 (41) | 125 (52) | 2 | <1% |

EXAMPLE IX

In this example, the concentration of N-methylglucamine was varied to demonstrate the extremely wide effective temperature range of this chemical for the reduction of silver. The reaction temperature was also varied over the range of 20° C., 30° C., 38° C. and 46° C.

The preferred reducer, N-methylglucamine, was dissolved in a sodium hydroxide/ammonium hydroxide concentrate as shown below. The reducer concentration was varied from 30 grams/liter to 150 grams/liter and was used in equal volumes with a silver concentrate according to Example I containing 250 grams/liter of silver nitrate. Both concentrates were diluted 30 times with deionized water before use and reacted in a beaker sensitized with stannous ions as described in Example I.

Alkaline Reducer Concentrate 150 grams/liter sodium hydroxide 100 mls/liter ammonium hydroxide (28% $NH_3$)

Varied concentrations of N-methylglucamine—see Table II

Diluted to 1 liter of deionized water

As a result of these tests, as shown in Table II, it will be seen that the concentration of N-methylglucamine can be varied over a wide range without affecting the plating capability of this reducer. It should be noted that Table II shows reducer concentrations in grams/liter of N-methylglucamine as required to form the reducer concentrate. However, it is the molar ratio of reducer to silver nitrate and not the absolute concentrations of the reactive components which is important in determining the effectiveness of the deposition process.

The absolute concentration of the starting concentrates and working concentrates may be varied over a relatively wide range. The reducer concentrate range of 30–150 grams/liter when used with a silver concentrate having 250 grams/liter of silver nitrate provides a molar ratio of reducer to silver nitrate ranging from 1:9.5 where the least (30 g/l) reducer is used to 1:1.9 where the most (150 g/l) is used.

Higher solution temperature increased the amount of silver deposited on the beaker. This demonstrates that this new reducer is effective over a wide range of temperatures. The brightness and reflectivity of N-methylglucamine (first surface) was superior to that of silver films deposited by sorbitol and sodium gluconate at these various temperatures.

TABLE II

| Concentration of N—Methylglucamine | Reaction Temperature °Centigrade | Reaction Time (minutes) | Silver Deposit (milligrams) |
|---|---|---|---|
| 30 | 20 | 1 | 5.4 |
| 40 | 20 | 1 | 5.3 |
| 60 | 20 | 1 | 5.1 |

TABLE II-continued

| Concentration of N—Methylglucamine | Reaction Temperature °Centigrade | Reaction Time (minutes) | Silver Deposit (milligrams) |
|---|---|---|---|
| 80 | 20 | 1 | 5.6 |
| 100 | 20 | 1 | 5.4 |
| 125 | 20 | 1 | 5.4 |
| 150 | 20 | 1 | 4.8 |
| 30 | 30 | 1 | 8.0 |
| 40 | 30 | 1 | 8.0 |
| 60 | 30 | 1 | 8.5 |
| 80 | 30 | 1 | 9.2 |
| 100 | 30 | 1 | 8.9 |
| 125 | 30 | 1 | 8.9 |
| 150 | 30 | 1 | 7.4 |
| 30 | 38 | 1 | 10.7 |
| 40 | 38 | 1 | 10.9 |
| 60 | 38 | 1 | 10.7 |
| 80 | 38 | 1 | 10.0 |
| 100 | 38 | 1 | 11.2 |
| 125 | 38 | 1 | 12.0 |
| 150 | 38 | 1 | 10.6 |
| 30 | 46 | 1 | 14.6 |
| 40 | 46 | 1 | 12.5 |
| 60 | 46 | 1 | 14.6 |
| 80 | 46 | 1 | 14.8 |
| 100 | 46 | 1 | 14.7 |
| 125 | 46 | 1 | 14.7 |
| 150 | 46 | 1 | 13.9 |

EXAMPLE X

In the following example, the three-part process employing the reducer of the invention in combination with invert sugar was demonstrated. The Silver Concentrate was diluted 30 times with deionized water. The Alkaline Reducer and Invert Sugar Concentrate were diluted 15 times each in separate containers. The diluted Alkaline Reducer and Invert Sugar Concentrates were mixed together in equal quantities (2.5 cc of each) just prior to mixture with the diluted silver solution. The solutions were prepared as follows:

Three-part Process

Silver Concentrate
- 250 grams/L silver nitrate
- 400 ml/L ammonium hydroxide (28% $NH_3$)
- Diluted to 1 liter with deionized water Alkaline Reducer Concentrate
- 200 grams/L sodium hydroxide
- 50 ml/L ammonium hydroxide (28% $NH_3$)
- 75 grams/L N-methylglucamine
- Diluted to 1 liter with deionized water Invert Sugar Concentrate
- 40 to 120 grams/L invert sugar—(see Table III)
- 1 ml/L sulfuric acid—97%
- 6 ml/L formaldehyde—37%
- Diluted to 1 liter with deionized water The reaction was allowed to proceed for 1 minute at various temperatures and various concentrations as shown in Table III. The reaction proceeded in a beaker which was cleaned and sensitized as outlined in Example I.

The silver film that was deposited was very bright on the first surface and the initial deposit was very smooth and uniform.

Temperature was found to be an important factor where efficiency of the plating process is concerned. Higher temperatures improved the plating efficiency when compared to room temperature reactions.

It was noted during these experiments that the silver film did not blush at the higher reaction temperatures, whereas the addition of other explosion inhibitors can result in blushing of the silver film at elevated temperatures.

A further advantage of adding N-methylglucamine to the alkali solution of a three-part system is that the reducers of the invention prevent the formation of explosive silver compounds as described in Example XII and Table IV.

TABLE III

| INVERT SUGAR CONCENTRATION (GRAMS/LITER) | REACTION TEMPERATURE (°CENTIGRADE) | SILVER DEPOSIT (MILLIGRAMS) |
|---|---|---|
| 40 | 21 | 6.1 |
| 40 | 32 | 11.0 |
| 40 | 43 | 16.9 |
| 60 | 21 | 5.8 |
| 60 | 32 | 8.9 |
| 60 | 43 | 14.2 |
| 80 | 21 | 5.4 |
| 80 | 32 | 10.4 |
| 80 | 43 | 13.3 |
| 100 | 21 | 5.2 |
| 100 | 32 | 9.8 |
| 100 | 43 | 14.3 |
| 120 | 21 | 4.3 |
| 120 | 32 | 9.7 |
| 120 | 43 | 12.9 |

EXAMPLE XI

The reducer of this invention as used in Example I was applied to a polycarbonate and a poly-methylmethacrylate (PMMA) substrate.

The surface of the substrate was cleaned and then "wetted" using conventional methods known to those skilled in the art. The N-methylglucamine reducer deposited a very brilliant silver film.

EXAMPLE XII

Since the reducers of the present invention are stable in concentrated alkali and concentrated silver diamino solution, they are able to inhibit the formation of explosive silver-nitrogen compounds if concentrated alkali and concentrated silver amine solutions are inadvertently mixed. The formation of fulminating silver consists of the silver compounds silver amide ($AgNH_2$), silver imide ($Ag_2NH$) and silver nitride ($Ag_3N$). Silver nitride is the most unstable. To demonstrate the nonexplosive capabilities of these new reducers, various ratios of concentrated silver and concentrated alkali were mixed in a beaker and allowed to react for 24 hours. After 24 hours, each beaker was disturbed using a stainless steel spatula to mix the reacted by-products. If the mixture is explosive, a small amount of mixing or jarring will result in a spontaneous explosion.

The solutions used in this test were as follows:

Silver Concentrate
- 250 grams/L silver nitrate
- 600 ml/L ammonium hydroxide—(28% $NH_3$)
- Diluted to 1 liter with water Alkali/Reducer Concentrate
- 200 grams/L sodium hydroxide
- 150 ml/L ammonium hydroxide—(28% $NH_3$)
- 30 to 60 grams/L N-methylglucamine or glucosaminic acid (See Table IV)

Sample 1 was a control which did not contain a reducing agent. In this sample, the explosive silver nitride was formed. This test was performed a number of times and resulted in a powerful explosion each time. Very little jarring of the beaker was required to cause the explosion to take place.

In all of the samples using N-methylglucamine (NMG) and glucosaminic acid, the explosive silver nitride was *not* formed. No amount of jarring of the beaker could cause an explosion to occur. The presence of the stable reducer in the alkaline pH reduces the silver immediately and thus prevents the formation of the dangerous silver amide, imide or nitride compounds.

Visually, it was apparent that the silver was being plated out in the solution within a minute of mixture. After 24 hours, a bright silver film had plated in the beakers that contained one of the reducers of the invention. However, the silver-alkali concentrate mixture of Sample I had a dark, dull appearance and did not have a bright silver film plated in its beaker after 24 hours.

As a result, a further advantage of this invention is the nonexplosive nature of the concentrates when the reducers described herein are used.

TABLE IV

Results of Explosion - Proof Capabilities of New Reducers

| Sample # | ml. Silver Concentrate | mls. of 200 gm/L NaOH | Reducer Concentrate grams/per liter | Results - after 24 hours |
|---|---|---|---|---|
| 1 | 3 | 3 | None | Highly explosive Shatters beaker and detonates with great force |
| 2 | 1 | 9 | NMG-60 | No explosion |
| 3 | 3 | 7 | NMG-60 | No explosion |
| 4 | 5 | 5 | NMG-60 | No explosion |
| 5 | 7 | 3 | NMG-60 | No explosion |
| 6 | 9 | 1 | NMG-60 | No explosion |
| 7 | 3 | 7 | NMG-30 | No explosion |
| 8 | 5 | 5 | NMG-30 | No explosion |
| 9 | 7 | 3 | NMG-30 | No explosion |
| 10 | 3 | 3 | Glucosaminic-60 | No explosion |
| 11 | 5* | 5 | *NMG dissolved in the silver concentrate-60 | No explosion |

Since certain changes may be made in providing the above compositions and in carrying out the above method without departing from the spirit and scope of the invention, it is intended that all matter contained in the above description shall be interpreted as illustrative and not in a limiting sense.

I claim:

1. In a method for the electroless deposition of metallic silver wherein a substrate is contacted with an aqueous alkaline medium containing a water soluble ionic silver composition capable of reduction to metallic silver and a reducer for said composition, the improvement which comprises providing as said reducer an effective amount of a compound represented by the general formula, $$R^2—(CHR^1)_n—CH_2OH$$

where n is two (2) to seven (7), $R^2$ is represented by the formula COOH or $CH_2R^1$, each $R^1$ group is independently selected from the class consisting of OH, $NH_2$, $NHCH_3$, $NHC_2H_5$ and $NHC_3H_7$ and at least one of the $R^1$ groups is $NH_2$, $NHCH_3$, $NHC_2H_5$ or $NHC_3H_7$.

2. A method according to claim 1 wherein n is four (4).

3. A method according to claim 1 wherein only one of $R_1$ groups is $NH_2$, $NHCH_3$, $NHC_2H_5$ or $NHC_3H_7$ the remaining $R_1$ groups being OH.

4. A method according to claim 3 wherein n is four (4).

5. A method according to claim 4 wherein $R^2$ is $CH_2NH_2$ or $CH_2NHCH_3$.

6. A method according to claim 4 wherein the reducer compound is N-methylglucamine, d-glucamine or glucosaminic acid.

7. A method according to claim 6 wherein the molar ratio of reducer to ionic silver compound is in the range of 1:10 to 1:0.5

8. A method according to claim 6 wherein the molar ratio of reducer to ionic silver compound is in the range of 1:6 to 1:2.

9. A method according to claim 1 wherein the molar ratio of reducer to ionic silver compound is in the range of 1:10 to 1:0.5

10. A method according to claim 1 wherein the silver composition comprises ammoniacal silver nitrate.

11. A method according to claim 1 wherein the reducer compound is N-methylglucamine, d-glucamine, or glucosaminic acid, the ionic silver composition comprises ammoniacal silver nitrate, and the deposition is effected in the presence of a strong base.

12. A method according to claim 11 wherein the strong base is sodium hydroxide.

13. A method according to claim 1 wherein the aqueous alkaline medium containing the water soluble ionic silver composition forms a first solution and the reducer is mixed with a strong base in an aqueous medium to form a second solution, the two solutions being used in a two-part silvering method.

14. A method according to claim 1 wherein the aqueous alkaline medium containing the water soluble ionic silver composition is mixed with the reducer to form a first solution and a complexing agent and strong base are mixed in an aqueous medium to form a second solution, the two solutions being used in a two-part silvering method.

15. A method according to claim 14 wherein a buffer is added to the first solution.

16. A method according to claim 15 wherein the buffer is ammonium nitrate or ammonium citrate.

17. A method according to claim 1 wherein the aqueous alkaline medium containing the water soluble ionic silver composition forms a first solution, the reducer is mixed with an aqueous medium to form a second solution and a strong base is mixed with an aqueous medium to form a third solution, the three solutions being used in a three-part silvering method.

18. A method according to claim 1 wherein a second reducer is also employed.

19. The method of claim 18 wherein the second reducer is contained in an aqueous solution separate from the aqueous alkaline silver solution.

20. The method of claim 19 wherein a three-part silvering method is employed.

21. The method of claim 20 wherein the aqueous alkaline silver solution forms a first solution, the reducer of the invention is contained in an aqueous alkaline second solution, and the second reducer is contained in a third aqueous solution.

22. The method of claim 21 wherein the second reducer is invert sugar.

23. The method of claim 22 wherein the reducer of the invention is N-methylglucamine.

24. In a silvering solution comprising an aqueous alkaline medium containing a water soluble ionic silver composition capable of reduction to metallic silver and a reducer for said composition, the improvement which comprises providing as said reducer an effective amount of a compound represented by the general formula, $$R^2—(CHR^1)_n—CH_2OH$$

where n is two (2) to seven (7), $R^2$ is represented by the formula COOH or $CH_2R^1$, each $R^1$ group is independently selected from the class consisting of OH, $NH_2$, $NHCH_3$, $NCHC_2H_5$ and $NHC_3H_7$ and at least one of the $R^1$ groups is $NH_2$, $NHCH_3$, $NHC_2H_5$ or $NHC_3H_7$.

25. A silvering solution according to claim 24 wherein n is four (4).

26. A silvering solution according to claim 25 wherein only one of the $R_1$ groups is $NH_2$, $NHCH_3$, $NHC_2H_5$ or $NHC_3H_7$ the remaining $R_1$ groups being OH.

27. A silvering solution according to claim 26 wherein n is four (4).

28. A silvering solution according to claim 27 wherein said compound is N-methylglucamine, d-glucamine or glucosaminic acid.

29. In a reducer solution for silvering comprising an aqueous alkaline medium containing a strong base and a reducer capable of reducing an ionic silver composition to metallic silver, the improvement which comprises providing as said reducer an effective amount of a compound represented by the general formula.

$$R^2—(CHR^1)_n—CH_2OH$$

where n is two (2) to seven (7), $R^2$ is represented by the formula COOH or $CH_2R^1$, each $R^1$ group is independently selected from the class consisting of OH, $NH_2$, $NHCH_3$, $NHC_2H_5$ and $NHC_3H_7$ and at least one of the $R^1$ groups is $NH_2$, $NHCH_3$, $NHC_2H_5$ or $NHC_3H_7$.

30. A silvering solution according to claim 29 wherein n is four (4).

31. A silvering solution according to claim 30 wherein only one of the $R_1$ groups is $NH_2$, $NHCH_3$, $NHC_2H_5$ or $NHC_3H_7$ the remaining $R_1$ groups being OH.

32. A silvering solution according to claim 31 wherein n is four (4).

33. A silvering solution according to claim 32 wherein said compound is N-methylglucamine, d-glucamine or glucosaminic acid.

* * * * *

UNITED STATES PATENT AND TRADEMARK OFFICE

CERTIFICATE OF CORRECTION

PATENT NO. : 4,737,188

DATED : April 12, 1988

INVENTOR(S) : Harry Bahls

It is certified that error appears in the above-identified patent and that said Letters Patent is hereby corrected as shown below:

In the Claims

Column 15, line 28, that portion of the formula reading "$NCHC_2H_5$" should read --$NHC_2H_5$--.

Signed and Sealed this

Eleventh Day of February, 1992

*Attest:*

HARRY F. MANBECK, JR.

*Attesting Officer*

*Commissioner of Patents and Trademarks*